US007111392B2

(12) United States Patent
Irie et al.

(10) Patent No.: US 7,111,392 B2
(45) Date of Patent: Sep. 26, 2006

(54) METHOD OF PRODUCING A FRAGILE SUBSTRATE CONTAINER

(75) Inventors: Tohru Irie, Nagoya (JP); Akinobu Morikawa, Nishikamo-gun (JP)

(73) Assignee: Sango Co., Ltd., Nagoya (JP)

( * ) Notice: Subject to any disclaimer, the term of this patent is extended or adjusted under 35 U.S.C. 154(b) by 484 days.

(21) Appl. No.: 10/637,677

(22) Filed: Aug. 11, 2003

(65) Prior Publication Data

US 2004/0031149 A1 Feb. 19, 2004

(30) Foreign Application Priority Data

Aug. 14, 2002 (JP) ..... 2002-236401

(51) Int. Cl.
*B21D 51/26* (2006.01)

(52) U.S. Cl. ..... 29/890

(58) Field of Classification Search ..... 29/890, 29/515, 516, 520, 446
See application file for complete search history.

(56) References Cited

U.S. PATENT DOCUMENTS

| | | | | |
|---|---|---|---|---|
| 4,969,264 | A * | 11/1990 | Dryer et al. | 29/890 |
| 5,329,698 | A | 7/1994 | Abbott | |
| 5,755,025 | A | 5/1998 | Wirth et al. | |
| 5,937,516 | A * | 8/1999 | De Sousa et al. | 29/890 |
| 6,381,843 | B1 | 5/2002 | Irie et al. | |
| 6,389,693 | B1 | 5/2002 | Aranda et al. | |
| 6,769,281 | B1 * | 8/2004 | Irie et al. | 29/890 |
| 6,954,988 | B1 * | 10/2005 | Mayfield | 29/890 |
| 2004/0237305 | A1 * | 12/2004 | Morikawa et al. | 29/896.62 |
| 2005/0138786 | A1 * | 6/2005 | Irie et al. | 29/446 |

FOREIGN PATENT DOCUMENTS

| | | | |
|---|---|---|---|
| EP | 0 982 480 A2 | | 3/2000 |
| EP | 1 074 704 A2 | | 2/2001 |
| EP | 1 344 911 A1 | | 9/2003 |
| JP | A 64-60711 | | 3/1989 |
| JP | A 2-268834 | | 11/1990 |
| JP | A 8-42333 | | 2/1996 |
| JP | A 9-170424 | | 6/1997 |
| JP | A 9-234377 | | 9/1997 |
| JP | A 2001-107725 | | 4/2001 |
| JP | A 2001-355438 | | 12/2001 |
| JP | A 2002-50383 | | 2/2002 |
| JP | A 2002-68709 | | 3/2002 |
| JP | 2002-178045 | * | 6/2002 |
| JP | 2003-003837 | * | 1/2003 |

(Continued)

*Primary Examiner*—Eric Compton
(74) *Attorney, Agent, or Firm*—Oliff & Berridge, PLC

(57) ABSTRACT

The present invention is directed to a method of producing a container such as a catalytic converter for holding a fragile substrate in a cylindrical housing with a shock absorbent member wrapped around the substrate, with an appropriate holding force determined on the basis of frictional force between the shock absorbent member and the one with the smaller coefficient of friction out of the substrate and the cylindrical housing. The method comprises the steps of (1) inserting the substrate with the shock absorbent member wrapped around the substrate, into the cylindrical housing loosely, (2) applying an axial load to the substrate so as to move the substrate along a longitudinal axis of the cylindrical housing by a predetermined distance, monitoring the axial load applied to the substrate, and (3) reducing a diameter of at least a part of the cylindrical housing with the substrate held therein along the longitudinal axis of the cylindrical housing, with the shock absorbent member being compressed, to such an extent that the axial load equals a predetermined value.

11 Claims, 6 Drawing Sheets

FOREIGN PATENT DOCUMENTS

| | | | |
|---|---|---|---|
| JP | 2003-225834 | * | 8/2003 |
| WO | WO 02/24297 A2 | | 3/2002 |
| WO | WO 02/095198 A1 | | 11/2002 |

* cited by examiner

METHOD OF PRODUCING A FRAGILE SUBSTRATE CONTAINER

BACKGROUND OF THE INVENTION

1. Field of Invention

The present invention relates to a method of producing a container for holding a fragile substrate in a cylindrical housing, with a shock absorbent member wrapped around the substrate, for use in a fluid treatment device, and more particularly to a method of producing a catalytic converter for holding a catalyst substrate of a honeycomb structure, with a shock absorbent mat wrapped around it in a cylindrical housing.

2. Description of Related Arts

In recent automotive vehicles, a catalytic converter, a diesel particulate filter (abbreviated as DPF) and the like have been equipped. In order to produce them, generally employed is such a method for wrapping a shock absorbent member around a fragile ceramic catalyst substrate (or, filter), and stuffing them into a cylindrical housing (casing), with the shock absorbent member being compressed.

For example, Japanese Patent Laid-open Publication No. 2001-355438 proposes a method of producing a catalytic converter, by measuring the outer diameter of a catalyst substrate, when the catalyst substrate with a holding material mounted around its periphery is stuffed (pressed) into a holding cylinder, and then stuffing the catalyst substrate with the holding material mounted thereon into the holding cylinder with its inner diameter adapted for the measured outer diameter. Also, it is proposed to measure the outer diameter of the holding material mounted on the catalyst substrate, and stuff the catalyst substrate with the holding material mounted thereon into the holding cylinder with its inner diameter adapted for the measured outer diameter. Furthermore, it is proposed to measure the outer diameter of the holding material in such a state that a certain pressure is applied to the holding material. It is also proposed to select a holding cylinder having a proper inner diameter, out of a plurality of holding cylinders with various inner diameters different from one another, which were provided in advance.

In contrast, it is proposed such a method called as "sizing" or "calibrating", wherein after the catalyst substrate and a shock absorbent mat mounted thereon were inserted into a cylindrical member, the diameter of the cylindrical member is reduced until the shock absorbent mat will be compressed to the most appropriate compressed amount, as disclosed in Japanese Patent Laid-open Publication Nos. 64-60711, 8-42333, 9-170424, 9-234377, U.S. Pat. Nos. 5,329,698, 5,755,025, 6,389,693, and European Patent Publication No. EP0982480A2 and so on. Among them, in Japanese Patent Laid-open Publication No. 9-234377, it is proposed to reduce a casing along its entire longitudinal length, in order to solve a problem in its prior art as disclosed in Japanese Patent Laid-open Publication No. 2-268834. In the former Publication, it is stated about the latter Publication that there is disclosed a catalytic converter with a central portion of a tubular body reduced in diameter to form a compressed portion, and compress a support mat to support a ceramic honeycomb body in the casing. And, it is stated in the former Publication that the above problem will be caused, as a clearance between the outer circumference of the honeycomb body and the inner circumference of the casing is large in a direction from an end of the compressed portion toward cone portions which are not reduced in diameter.

According to the conventional method by the stuffing process as described above, on the basis of density of a shock absorbent mat served as the shock absorbent member, which is called as GBD (abbreviation of gap bulk density), an annular clearance between the outer diameter of the catalyst substrate and the inner diameter of the cylindrical housing is determined, in general. The GBD is the value obtained from [weight per unit area/bulk gap]. According to the bulk density of the shock absorbent mat, pressure (Pascal) is created to hold the catalyst substrate. The pressure has to be adjusted to a value which will not exceed the strength of the catalyst substrate, and to a value which is capable of holding the catalyst substrate applied with vibration and exhaust gas pressure not to be moved in the cylindrical housing. Therefore, the shock absorbent member (shock absorbent mat) is required to be stuffed to create the GBD within a predetermined design range, and the GBD is required to be maintained for a life cycle of the product.

According to the conventional method by the stuffing process as described above, however, an error in the outer diameter of the catalyst substrate necessarily caused when producing it, an error in the inner diameter of the cylindrical housing, and an error in weight per unit area of the shock absorbent mat disposed between them are added to create an error in GBD. Therefore, it can not be a practical solution for mass-production to find a combination of each member adapted to minimize the error in GBD. Furthermore, the GBD itself is varied depending upon the property or individual difference of the shock absorbent mat. And, the GBD relies on the value measured on a flat plane, so that it does not indicate the value measured in the case where the shock absorbent mat is tightly wrapped around the catalyst substrate. Accordingly, it has been desired to stuff the catalyst substrate properly into the cylindrical housing, without relying on the GBD.

On the contrary, according to the conventional sizing method, it is proposed to measure the outer diameter of the catalyst substrate and the inner diameter of the cylindrical housing in advance, to determine an appropriate compression amount for the shock absorbent member, and then reduce the diameter by the determined compression amount. However, it is difficult to determine whether the final compression amount is appropriate or not. This is because when reducing the diameter of the metallic cylindrical member, it is required to reduce the diameter slightly smaller than a target diameter (so called overshooting), in view of a spring back of the cylindrical member. As a result, excessive compression force might be created. Also, a further difficulty is resulted from the fact that when reducing the diameter of the metallic cylindrical member, unavoidable change in thickness of its wall is caused.

In order to solve the problem caused by the overshooting or the like as described above, such a method for measuring the outer diameter of the catalyst substrate in advance, and reducing the diameter of the housing on the basis of the compression amount or target thickness of the shock absorbent mat has been proposed, in the U.S. Pat. Nos. 5,755,025, 6,389,693 and European Patent Publication No. EP0982480A2 as cited before. However, nothing is considered about the various errors caused with respect to the shock absorbent mat including the error in weight per unit area of the shock absorbent mat as described before. Therefore, the ultimate problem about the error in pressure applied to the catalyst substrate can not be avoided.

With respect to a holding force for holding the catalyst substrate in a predetermined position within the cylindrical housing, the holding force in a radial direction of the cylindrical housing corresponds to the pressure reproduction force of the shock absorbent mat acting on the outer surface of the catalyst substrate and the inner surface of the cylindrical housing, in a direction perpendicular to those surfaces. On the other hand, with respect to the cylindrical housing fixed to the exhaust system for the automotive vehicle, for example, the catalyst substrate and shock absorbent mat are applied with force in their axial directions, due to vibration or exhaust gas pressure. In opposition to the axial force, a holding force is required for them in the axial (longitudinal) direction of the cylindrical housing, which holding force is created by first frictional force between the shock absorbent mat and the catalyst substrate, and second frictional force between the shock absorbent mat and the cylindrical housing.

The first and second frictional forces are indicated by the product of multiplying the pressure reproduction force of the shock absorbent mat and the coefficient of static friction between the shock absorbent mat and the outer surface of the catalyst substrate, and the product of multiplying the pressure reproduction force of the shock absorbent mat and the coefficient of static friction between the shock absorbent mat and the inner surface of the cylindrical housing, respectively. In this respect, as for the holding force in the axial (longitudinal) direction of the cylindrical housing, the frictional force between the shock absorbent mat and the remaining one with the smaller coefficient of friction is dominant. With respect to the catalyst substrate and cylindrical housing with known coefficients of static friction, therefore, frictional forces are made clear. In order to ensure the requisite frictional forces, it is required to increase the pressure applied to the shock absorbent mat. In the case where the catalyst substrate is fragile, it is required to ensure the axial holding force within the pressure limit to the shock absorbent mat, to avoid excessive radial load applied to the catalyst substrate.

Accordingly, it is preferable to determine the pressure applied to the shock absorbent mat, on the basis of the one with the smaller coefficient of static friction, out of the coefficient of static friction of the outer surface of the catalyst substrate and the coefficient of static friction of the inner surface of the cylindrical housing, and reduce the diameter of the cylindrical housing in accordance with the determined pressure. In the prior methods, however, generally employed is a control on the basis of the GBD of shock absorbent mat as described before, so that a control through an estimation on the basis of a substituted value has been employed. Therefore, those estimated factors are added together to cause the unavoidable error. Also, the holding force that is caused by the frictional force between the shock absorbent mat and catalyst substrate, and the holding force that is caused by the frictional force between the shock absorbent mat and cylindrical housing, are eventually confused with each other, to determine the dimensions of each parts.

As a result, when holding the catalyst substrate in the cylindrical housing with the shock absorbent mat disposed between them, most appropriate parameter is the pressure (Pascal) applied to the substrate (catalyst substrate, or filter) through the shock absorbent mat (shock absorbent mat). If it is possible to measure the pressure directly, or measure a value directly corresponding to or similar to the pressure, and reduce the diameter of the cylindrical housing on the basis of one of the measured results, then it is possible to reduce the diameter of the cylindrical housing by a sizing process, with satisfactory accuracy.

However, it is very difficult to measure the above-described pressure itself directly. Especially in the case where the shock absorbent mat and catalyst substrate have been accommodated in the cylindrical housing, with the pressure created by the reaction force of the shock absorbent mat, it is required to insert a measuring device into the cylindrical housing so as to measure the pressure, and then remove the measuring device out of the cylindrical housing after measurement, which is too difficult to provide a realistic solution. Alternatively, it could be proposed to measure strain or the like created on the cylindrical housing, and use it as a factor indicative of the pressure. However, a sufficient accuracy required for the measured pressure could not be obtained.

SUMMARY OF THE INVENTION

Accordingly, it is an object of the present invention to provide a method of producing a container for holding a fragile substrate in a cylindrical housing, with a shock absorbent member wrapped around the substrate, substantially monitoring a holding force when holding the substrate in the cylindrical housing through the shock absorbent member, thereby to hold the substrate with the shock absorbent member wrapped around it in the cylindrical housing, appropriately. For example, the container is a catalytic converter for an automotive vehicle, and the substrate is a catalyst substrate of a honeycomb structure for use in the catalytic converter.

In accomplishing the above and other objects, the method comprises the steps of (1) inserting the substrate with the shock absorbent member wrapped around the substrate, into the cylindrical housing loosely, (2) applying an axial load to the substrate so as to move the substrate along a longitudinal axis of the cylindrical housing by a predetermined distance, monitoring the axial load applied to the substrate, and (3) reducing a diameter of at least a part of the cylindrical housing with the substrate held therein along the longitudinal axis of the cylindrical housing, with the shock absorbent member being compressed, to such an extent that the axial load equals a predetermined value.

In the method as described above, preferably, the diameter of the cylindrical housing is reduced at least twice, and the axial load is applied at least twice to the substrate so as to move the substrate along the longitudinal axis of the cylindrical housing by at least a first predetermined distance and second predetermined distance, respectively, monitoring the axial load applied to the substrate. And, preferably, a target reduced amount is provided for reducing the diameter of the cylindrical housing and holding the substrate in the cylindrical housing through the shock absorbent member with a desired holding force, on the basis of the applied axial loads and reduced amounts. Then, the diameter of the cylindrical housing is reduced by the target reduced amount.

The method may comprise the steps of (1) inserting the substrate with the shock absorbent member wrapped around the substrate, into the cylindrical housing, (2) determining a desired frictional force between the shock absorbent member and the one with the smaller coefficient of friction out of the substrate and the cylindrical housing, (3) providing a target reduced amount for reducing a diameter of at least a part of the cylindrical housing and holding the substrate in the cylindrical housing through the shock absorbent member with a desired holding force, on the basis of the desired frictional force, and (4) reducing the diameter of the cylindrical housing with the substrate held therein along the longitudinal axis of the cylindrical housing, with the shock absorbent member being compressed, by the target reduced amount.

In the method as described above, an axial load may be applied to the substrate so as to move the substrate along a longitudinal axis of the cylindrical housing by a predetermined distance, monitoring the axial load applied to the substrate, and the desired frictional force may be estimated on the basis of the axial load.

Furthermore, the diameter of the cylindrical housing may be reduced at least twice, and the axial load may be applied at least twice to the substrate so as to move the substrate along the longitudinal axis of the cylindrical housing by at least a first predetermined distance and second predetermined distance, respectively, monitoring the axial load applied to the substrate. And, a target reduced amount may be provided for reducing the diameter of the cylindrical housing and holding the substrate in the cylindrical housing through the shock absorbent member with a desired holding force, on the basis of the applied axial loads and reduced amounts. Then, the diameter of the cylindrical housing may be reduced by the target reduced amount.

In the methods as described above, the diameter of the cylindrical housing may be reduced according to a spinning process.

BRIEF DESCRIPTION OF THE DRAWINGS

The above stated object and following description will become readily apparent with reference to the accompanying drawings, wherein like reference numerals denote like elements, and in which.

DESCRIPTION OF THE PREFERRED EMBODIMENTS

Figure 1:
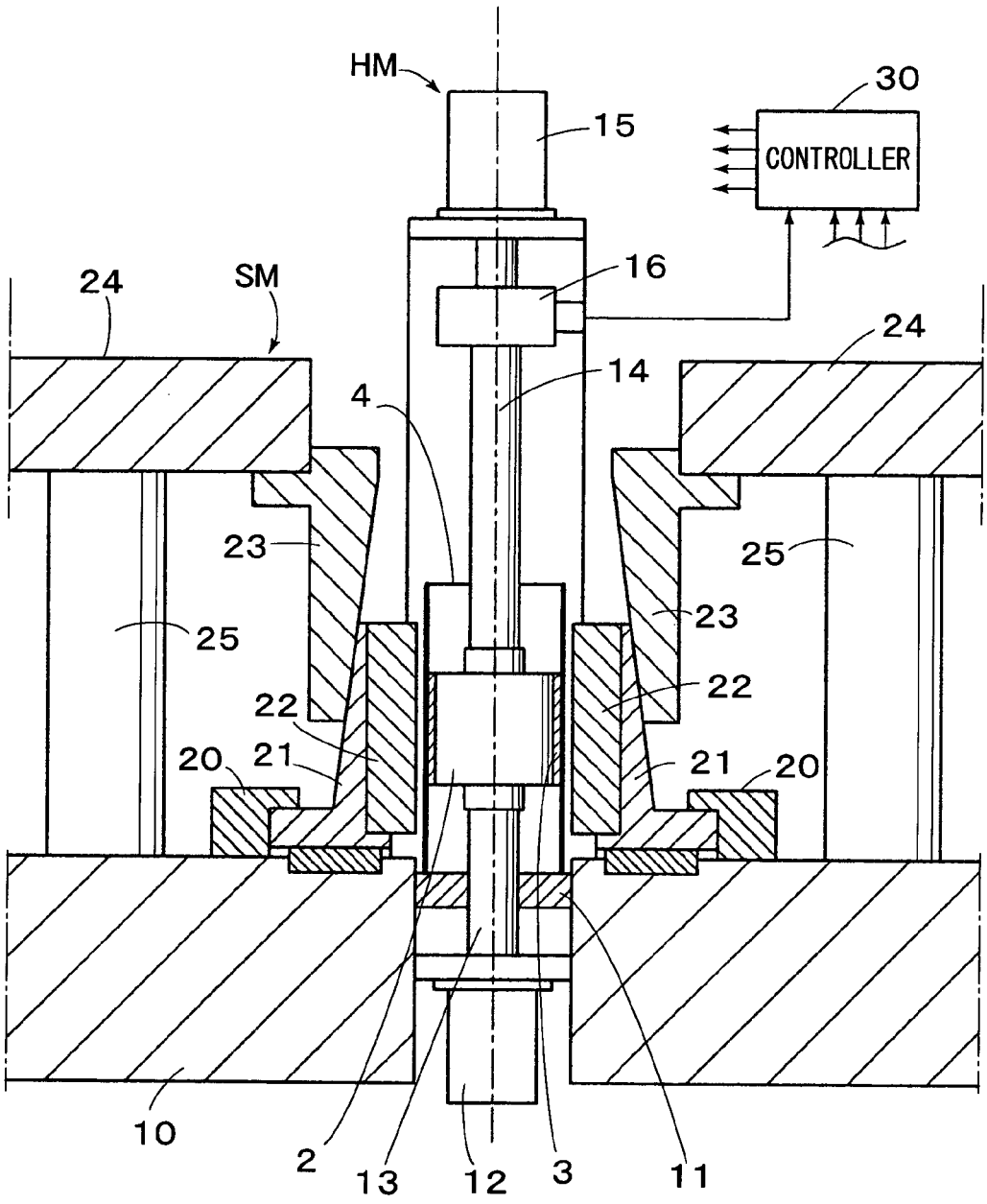
FIG. 1 is a sectional view showing a sizing apparatus for use in a method according to an embodiment of the present invention.

Referring to FIG. 1, there is schematically illustrated a sizing apparatus for producing a catalytic converter for an automobile as an embodiment using a method of producing a container for holding a fragile substrate in a cylindrical housing with a shock absorbent member wrapped around the substrate, for use in a fluid treatment device according to the present invention. The fluid treatment devices to be produced according to the present invention include the diesel particulate filter (DPF), a purification filter, and a reformer for use in a fuel cell as described in Japanese Patent publication Nos. 2002-50383 and 2002-68709, for example.

The cylindrical housing is called as an outer shell or casing. With respect to the catalytic converter, the fragile substrate corresponds to a catalyst substrate of a honeycomb structure, and the shock absorbent member corresponds to a shock absorbent mat for holding the catalyst substrate. With respect to the DPF, the fragile substrate corresponds to a filter of a honeycomb structure, and the shock absorbent member corresponds to a shock absorbent mat for holding the filter. In general, the catalyst substrate or filter of the honeycomb structure is formed into a columnar body with a generally circular cross section or a cylinder. According to the present invention, however, the substrate includes the one with a noncircular cross section, such as an elliptic cross section, oval cross section, cross section having a plurality of radiuses of curvature, polygonal cross section, and the like. The cross section of each passage (cell) of the catalyst substrate or the filter of DPF is not limited to a hexagon, but may be selected from other shapes such as a square or the like. And, the substrate may be made of ceramic or metal. In other words, its material and method for producing it are not limited herein.

According to the present embodiment, a shock absorbent mat 3, which serves as the shock absorbent member of the present invention, is wrapped around the catalyst substrate 2 as shown in the center of FIG. 1, and fixed by an inflammable tape, if necessary. In this respect, it is preferable to use a conventional wrapping manner by forming in advance an extension and a recess on the opposite ends of the shock absorbent mat 3, respectively, and wrapping the shock absorbent mat 3 around the catalyst substrate 2, with the extension and recess engaged with each other. Furthermore, a shock absorbent mat formed in a cylindrical shape may be used, whereby the shock absorbent mat comes to be placed in its mounted state around the catalyst substrate 2, by simply inserting the catalyst substrate 2 into the cylindrical mat.

The catalyst substrate 2 is a ceramic substrate of a honeycomb structure. The wall thickness of each cell has been made relatively thin, so that the wall is fragile comparing with the prior substrates. The shock absorbent mat 3 is constituted by an alumina mat which will be hardly expanded by heat, in this embodiment. A vermiculite mat having a thermal expansion property may be employed, or a combination of those mats may be used. Also, an inorganic fiber mat without binder impregnated may be used. As the pressure is varied depending upon the shock absorbent mat with or without the binder impregnated, and its impregnated amount, it is required to take those into consideration when the pressure is determined. Or, as for the shock absorbent mat, a wire-mesh with thin steal wires meshed, or the like may be used, and it may be combined with a ceramic mat. In addition, those may be used in combination with an annular metallic retainer, a seal ring made of wire mesh, or the like.

Next, the catalyst substrate 2 with the shock absorbent mat 3 wrapped around it will be loosely inserted into the cylindrical housing 4, or inserted into it in such a state as to be almost pressed into it, with an ultimate clearance remained for reducing its diameter to provide a desired diameter through several times of shrinking process. Then, the cylindrical housing 4 having the catalyst substrate 2 and shock absorbent mat 3 is held at a predetermined position, and a diameter of a predetermined part of the cylindrical housing 4 is reduced by a sizing apparatus SM as shown in FIG. 1. According to the present embodiment, a substrate holding device HM penetrates a base 10 to be supported thereon vertically, and a collet chuck of the sizing apparatus SM is disposed on the base 10. The substrate holding device HM includes a support 11 and a cylinder 12 fixed within a hole defined in the base 10, respectively, and a shaft 13 penetrates the support 11 to be slidably supported thereby and driven by the cylinder 12. Also, a shaft 14 whose end surface is held to face the end surface of the shaft 13, is supported by a cylinder 15 to move vertically. Between the shaft 14 and cylinder 15, a load cell 16 is disposed to measure an axial load, which will be applied by the cylinder 15 to the catalyst substrate 2 through the shaft 14. The load cell 16 is electrically connected to a controller 30.

The sizing apparatus SM includes a plurality of split dies 21 which are supported by an annular frame 20 having a c-shaped cross section so as to slide in a radial direction (toward a longitudinal axis) on the base 10. The split dies 21 have dies (collets) 22 secured to their inner sides. Each split die 21 has a tapered outer (back) surface, to be slidably fitted into the inside of a pushing die 23, which has a tapered inner surface to contact and slide on the tapered outer surface of the die 21. The pushing die 23 may be formed to provide a hollow cylinder, or provide split dies to contact the sprit dies 21, respectively. The pushing die 23 is secured to a pushing plate 24, which is supported by the base 10 to be movable vertically. Therefore, the pushing die 23 is moved by the pushing plate 24 vertically, e.g., downward in FIG. 1, the split dies 21 are moved radially (toward the longitudinal axis). The pushing plate 24 is actuated by a hydraulic pressure actuating device (not shown), which is controlled by the controller 30.

In operation, the cylindrical housing 4 is placed on the upper surface of the support 11, with the shaft 13 placed on the longitudinal axis of the cylindrical housing 4. Then, the catalyst substrate 2 with the shock absorbent mat 3 wrapped around it is loosely inserted into the cylindrical housing 4, and placed on the tip end surface of the shaft 13. And, the shaft 14 is moved downward by the cylinder 15 to hold the catalyst substrate 2 between its tip end surface and the tip end surface of the shaft 13. Then, the pushing plate 24 is actuated by the hydraulic pressure actuating device (not shown) to move the pushing die 23 downward in FIG. 1, so that the split dies 21 are moved radially toward the longitudinal axis of the cylindrical housing 4. As a result, a body portion (middle portion) of the cylindrical housing 4 and the shock absorbent mat 3 are compressed by the dies 22 to reduce the diameter of the cylindrical housing 4. The reduced amount is controlled accurately by the hydraulic pressure actuating device which is controlled by the controller 30. Consequently, the catalyst substrate 2 is held in a stable state within the cylindrical housing 4.

As described above, the hydraulic pressure actuating device (not shown) for actuating the sizing apparatus SM is controlled by the controller 30, and the sizing process by any amount of reduction can be achieved according to NC control, to enable a fine control. Furthermore, in the sizing process, a workpiece may be rotated occasionally to perform the index control, the cylindrical housing 4 can be reduced in diameter more uniformly about its entire periphery. The control medium for the sizing apparatus SM is not limited to the hydraulic pressure. With respect to its actuating and controlling system, any actuating system including a mechanical system, electric system, pneumatic system or the like may be employed, and preferably a CNC control system may be used.

Figure 2:
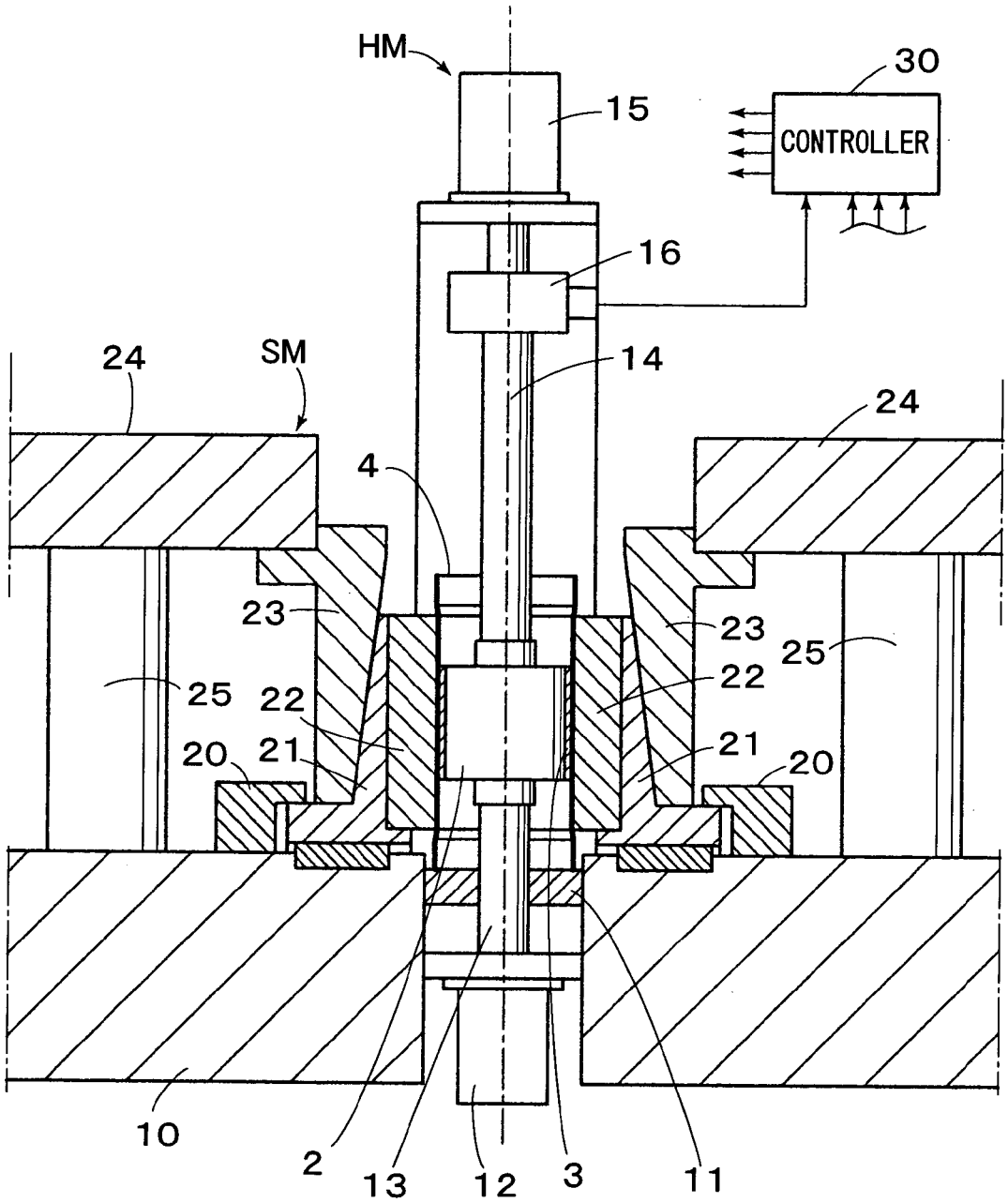
FIG. 2 is a sectional view showing a process for reducing a cylindrical housing by a sizing apparatus for use in a method according to an embodiment of the present invention.
Figure 8:
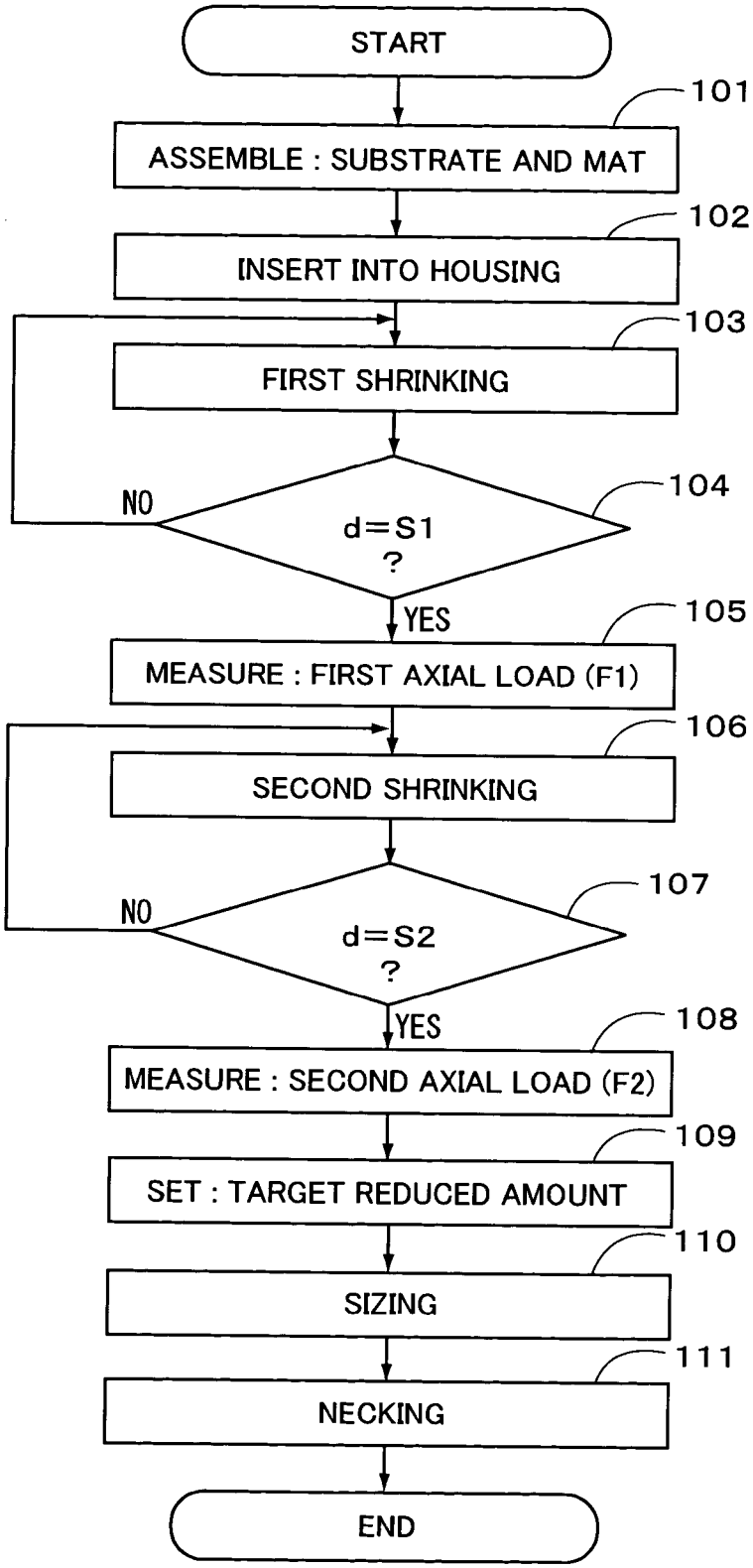
FIG. 8 is a flowchart showing an example of measurement and sizing process in a method according to an embodiment of the present invention.

Next will be explained an embodiment of the sizing process, wherein the body portion of the cylindrical housing 4 is shrinked together with the shock absorbent mat 3 according to the plurality of shrinking processes (twice in the present embodiment) by means of the sizing apparatus SM as described above, with reference to FIGS. 2–4, in accordance with a flowchart as shown in FIG. 8.

Figure 3:
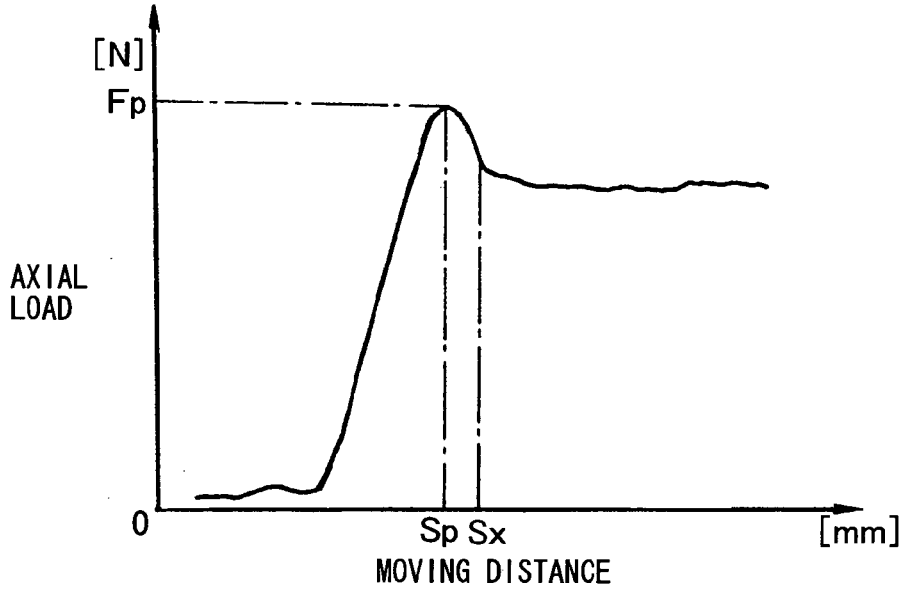
FIG. 3 is a diagram showing a relationship between an axially moving distance and axial load which is applied to a catalyst substrate, in such a state that a cylindrical housing is reduced to compress a shock absorbent member thereby to hold a catalyst substrate appropriately, in a method according to an embodiment of the present invention.

FIG. 3 shows a relationship between an axially moving distance (i.e., stroke) of the catalyst substrate 2 and axial load applied to the catalyst substrate 2, in the case where the catalyst substrate 2 with the shock absorbent member 3 wrapped around it is inserted into the cylindrical housing 4, and then the predetermined longitudinal part of the cylindrical housing 4 is reduced to compress the shock absorbent member 3 thereby to hold the catalyst substrate 2 appropriately. As describe before, the frictional force between the shock absorbent mat 3 and the catalyst substrate 2, and frictional force between the shock absorbent mat 3 and the cylindrical housing 4 can be indicated by the product of multiplying the pressure reproduction force of the shock absorbent mat 3 and the coefficient of static friction between the shock absorbent mat 3 and the outer surface of the catalyst substrate 2, and the product of multiplying the pressure reproduction force of the shock absorbent mat 3 and the coefficient of static friction between the shock absorbent mat 3 and the inner surface of the cylindrical housing 4, respectively. In this respect, as for the holding force in the axial (longitudinal) direction of the cylindrical housing 4, the frictional force between the shock absorbent mat 3 and the remaining one with the smaller coefficient of friction is dominant. With respect to the catalyst substrate 2 and cylindrical housing 4 with known coefficients of static friction, therefore, the required frictional force is made clear.

As shown in FIG. 3, with the axially moving distance of the catalyst substrate 2 increased, the axial load is increased to become its maximum value (Fp), which is called as drawing load, then rapidly reduced, and thereafter gradually reduced. Because the axial load corresponds to the frictional force between the shock absorbent mat 3 and the one with the smaller coefficient of friction out of the substrate 2 and the housing 4 in this case, the axially moving distance (Sp, e.g., 1.5 mm) of the catalyst substrate 2, which is obtained when the axial load equals the drawing load (Fp), corresponds to the stroke capable of obtaining the maximum frictional force. It is not so easy to define the axially moving distance (Sp), because various conditions are combined together. However, if the catalyst substrate 2 is moved by an axially moving distance (Sx) equal to or more than the value (Sp), the maximum frictional force, i.e., the drawing load (Fp) can be detected. Therefore, the axially moving distance (Sx) is set to be 2 mm (>Sp) for example, and the load is detected when the axial load equals the drawing load (Fp), in such a state that a proper compression load has been applied to the shock absorbent mat 3, and then the detected load is set to be a target (desired) axial load (Ft), in accordance with which the amount of shock absorbent mat 3 to be compressed (i.e., the diameter of cylindrical housing 4 to be reduced) is adjusted, so that the desired frictional force can be obtained between the shock absorbent mat 3 and the one with the smaller coefficient of friction.

Alternatively, may be monitored a coefficient of dynamic friction in a region of approximately stable state at a position where the axially moving distance is larger than the axially moving distance (Sx), i.e., a position at the right side to "Sx"

in FIG. 3). In other words, it can be determined in accordance with an individual designing or processing condition, whether the sizing process is controlled on the basis of the peak value (maximum coefficient of static friction), or the sizing process is controlled on the basis of the maximum coefficient of dynamic friction (in a moving condition). In any case, it is sufficient to monitor only a relative movement of the one with the smaller frictional force, which will begin moving first. Thus, it is apparent that the catalytic converter can be produced easily according to the present embodiment.

Figure 4:
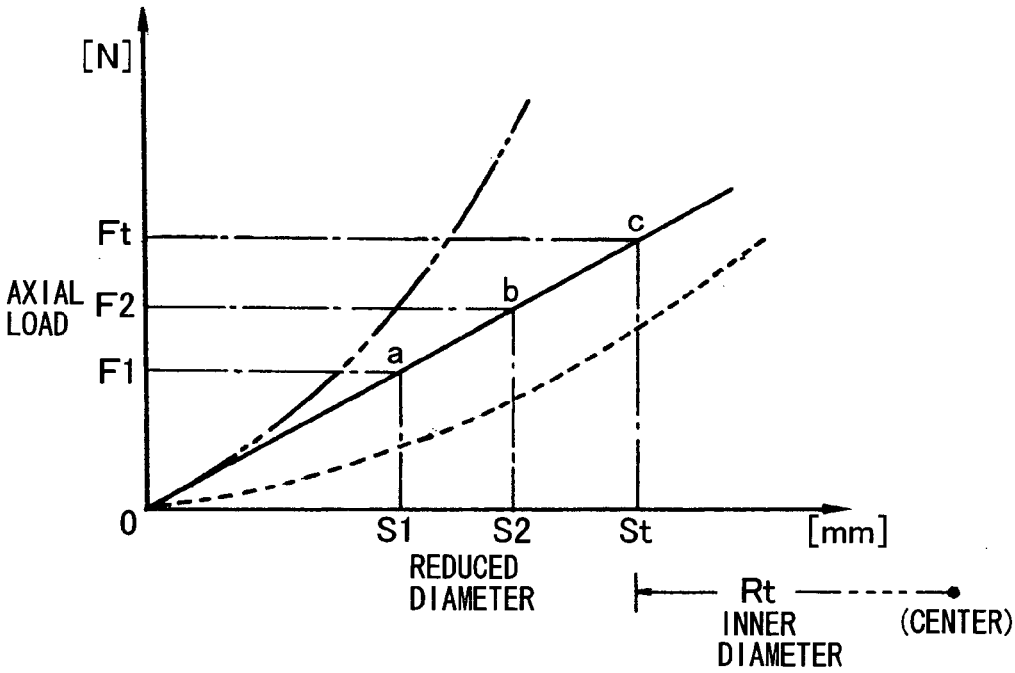
FIG. 4 is a diagram for showing a relationship between a reduced amount of a cylindrical housing for applying a compression load to a shock absorbent mat and a load applied to a catalyst substrate, in a method according to an embodiment of the present invention.

FIG. 4 shows a relationship between the reduced amount of the cylindrical housing 4 for applying the compression load to the shock absorbent mat 3 (abscissa), and the axial load applied to the catalyst substrate 2 (ordinate). A correlation property according to the present embodiment indicates approximately straight line, as can be seen in FIG. 4 by a solid line located in the middle between a two-dotted chain line indicative of a property with the maximum load and a broken line indicative of a property with the minimum load. The relationship as defined in FIG. 4 between the target axial load (Ft) provided when the compression load applied to the shock absorbent mat 3 is most appropriate, and the target reduced amount (St) of cylindrical housing 4 capable of providing the target axial load (Ft), which are provided in accordance with the property as shown in FIG. 3, can be defined by an embodiment of the method performed in accordance with the flowchart as shown in FIG. 8.

Referring to FIG. 8 showing the process of producing the catalytic converter, at the outset, the shock absorbent mat 3 is wrapped around the catalyst substrate 2 at Step 101. And, these are loosely inserted into the cylindrical housing 4, at Step 102. Then, a first shrinking process is performed at Step 103, where the predetermined longitudinal part of the cylindrical housing 4 is compressed together with the shock absorbent mat 3, so as to reduce the diameter of the cylindrical housing 4 until a reduced amount (d) equals a first reduced amount (S1) at Step 104, as a result of the first shrinking process at Step 103. In FIG. 4, the first reduced amount (S1) is a distance measured at a position "a" from the original position "0" in FIG. 4, which corresponds to the inner surface of the cylindrical housing 4 before the shrinking process is performed, and which can be measured by the radial moving distance of the split dies 21, on the basis of the detected hydraulic pressure of the hydraulic pressure actuating device (not shown) for actuating the pushing plate 24. Then, at Step 105, a first axial load (F1) is measured, when the axial load is applied to the catalyst substrate 2 so as to move it along the longitudinal axis of the cylindrical housing 4 by the axially moving distance (Sx) as shown in FIG. 3, e.g., 2 mm.

The program further proceeds to Step 106, where a second shrinking process is performed. The predetermined longitudinal part of the cylindrical housing 4 is compressed together with the shock absorbent mat 3, so as to reduce the diameter of the cylindrical housing 4 until the reduced amount (d) equals a second reduced amount (S2) at Step 107. Then, at Step 108, a second axial load (F2) is measured, when the axial load is applied to the catalyst substrate 2 so as to move it along the longitudinal axis of the cylindrical housing 4 by the axially moving distance (Sx), e.g., 2 mm, in the same direction as the first shrinking process. In this process, the second reduced amount (S2) is a distance measured at a position "b" from the position "0" in FIG. 4, which can be measured by the radial moving distance of the split dies 21, on the basis of the detected hydraulic pressure of the hydraulic pressure actuating device (not shown) for actuating the pushing plate 24. Therefore, the moving distance between the position "a" and position "b" is (S2−S1).

And, the program proceeds to Step 109, where the target reduced amount (St) is provided for holding the catalyst substrate 2 in the cylindrical housing 4 by a predetermined target holding force, which corresponds to the target axial load (Ft), in accordance with the correlation property between the first and second reduced amounts (S1, S2) and the first and second axial loads (F1, F2). Then, at Step 110, the cylindrical housing 4 is sized to reduce its diameter, so as to provide the target reduced amount (St) which corresponds to the desired axial load (Ft) as shown in FIG. 4. Alternatively, a target (desired) value (Rt in FIG. 4) may be provided for the inner diameter of the cylindrical housing 4, and the first and second axial loads (F1, F2) may be provided, when the cylindrical housing 4 is sized to reduce its diameter, so as to provide the first and second inner diameters (R1, R2). In this case, therefore, the target value (Rt) may be provided in accordance with the correlation property between the first and second inner diameters (R1, R2), and the first and second axial loads (F1, F2). In this case, the inner diameter of the cylindrical housing 4 can be obtained by subtracting the moving distance of the dies 22 (or split dies 21) from the predetermined. distance between the initial position of the dies 22 (or split dies 21) and the longitudinal axis of the cylindrical housing 4.

The measurement as described above is made twice by moving the catalyst substrate 2 against the cylindrical housing 4, in the same axial direction, by the predetermined distance (2 mm), respectively, so that the catalyst substrate 2 is displaced by 4 mm in total. Therefore, when the catalyst substrate 2 is placed in the cylindrical housing 4, the catalyst substrate 2 may be originally placed on a position retracted backward by the total displacement of 4 mm, in a direction opposite to the moving direction of the catalyst substrate 2. Or, the catalyst substrate 2 may be retracted backward by the total displacement in the direction opposite to the moving direction, after the cylindrical housing 4 was sized.

Alternatively, the measurement as described above is made twice by moving the catalyst substrate 2 against the cylindrical housing 4, in the axial direction opposite to each other, by the predetermined distance (2 mm), respectively. Thus, if the direction is reversed every measurement, the displacement will be cancelled after the measurement is achieved twice. Preferably, the multiple measurements may be made in the same direction, as in the present embodiment, because fewer error will be expected, if the measurement is made in such a state that the force is applied to the shock absorbing mat 3 in the same (constant) direction.

After the measurement is achieved twice as described above, the axial load may be measured at a position "c" in FIG. 4, as well. Generally, it can be estimated on the basis of the results measured at the two positions. Therefore, the measurement does not have to be made three times in a mass-production line for producing the converters. Also, in the case where it has been found that the correlation property is regressed to the straight line as shown in FIG. 4, it will be of almost no importance to measure the load at three or more positions, from the position "0" to the position "c" in FIG. 4. Specifically, the estimated correlation property line lies on a zone between the two curved lines including the straight line as shown in FIG. 4. In order to identify an appropriate point for the position "c" on the correlation line, therefore, it will be appropriate to measure the load at another one position other than the positions "a" and "b", and obtain a quadratic curve through a least square approximation on the basis of the measured three positions, and then identify the position "c" on the quadratic curve, whereby a more precise measurement could be achieved. In the mass-production of catalytic converters or the like according to the present invention, the above-described accuracy is not required. Therefore, the productivity is given priority according to the present embodiment, so that the linear regression based on only two positions as shown in FIG. 4 has been employed, so as to approximate the curve. If the axial movement of the catalyst substrate 2 and the measurement of the axial load applied to the catalyst substrate 2 can be made consecutively in the shrinking process of the cylindrical housing 4, the load measurement may be made, moving the catalyst substrate 2.

Figure 5:
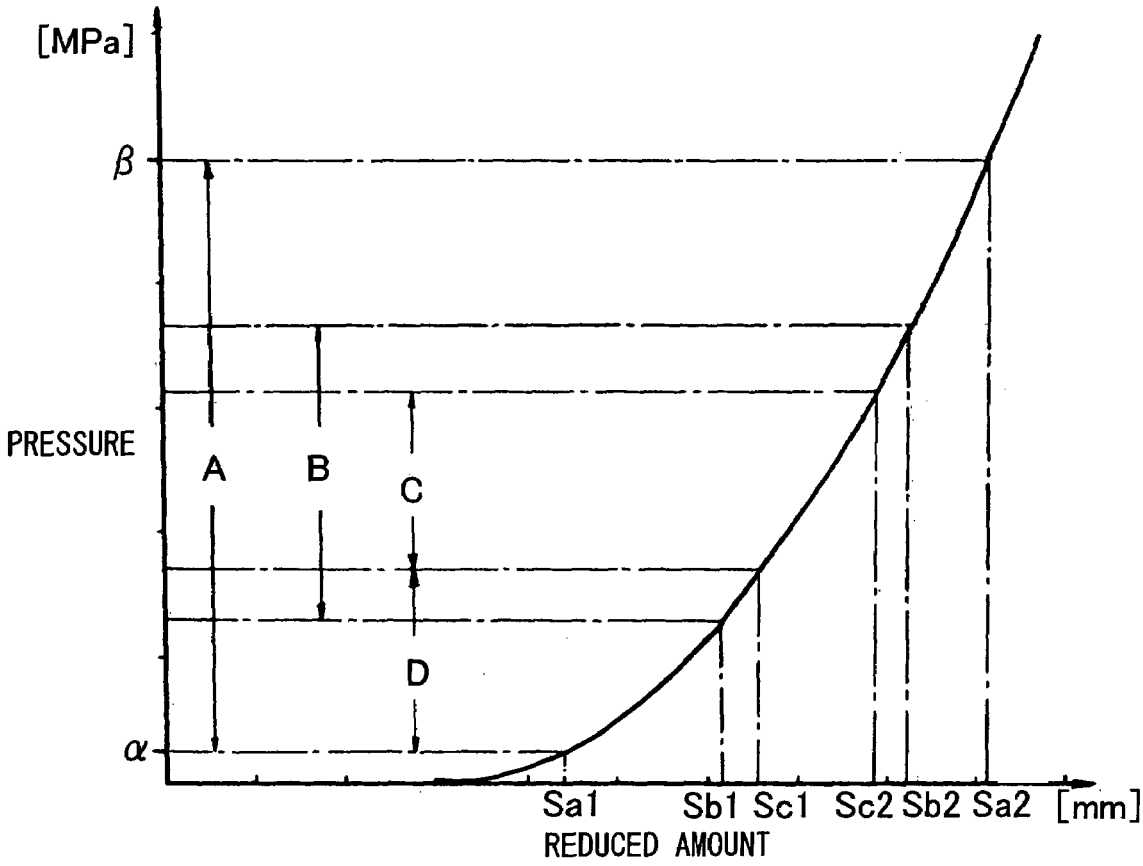
FIG. 5 is a diagram showing a pressure allowable range for an example of a shock absorbent member in a conventional catalytic converter.

In order to ensure a desired frictional force between the shock absorbent mat 3 and the one with the smaller coefficient of friction out of the catalyst substrate 2 and the cylindrical housing 4, it is required to increase the pressure applied to the shock absorbent mat 3. If the catalyst substrate 2 is fragile, it is necessary to ensure the axial holding force within a pressure limit provided for the shock absorbent mat 3, as shown in FIG. 5, so as to avoid an excessive radial load applicable to the catalyst substrate 2. In this case, it is desirable that the pressure of the shock absorbent mat 3 is made as strong as possible, and applied uniformly in the peripheral and axial directions, in view of the variation or aged change in pressure resulted from the error in the outer diameter of the catalyst substrate 2, or the pressure (whose minimum pressure is indicated by $\alpha$) for preventing the catalyst substrate from moving in the axial direction of the catalyst substrate 2 due to various accelerations when in use. If the compression force is provided to be excessive so as to satisfy the desire as described above, the catalyst substrate 2 might be fractured, so that the pressure can not be made greater than a predetermined pressure. The pressure that is applied when the catalyst substrate 2 is fractured, is called as isostatic strength $\beta$. Especially, in response to recent requirement of further improvement in exhaust purifying performance, further reduction in wall thickness has been required, so that the catalyst substrate 2 is getting much more fragile than the prior catalyst substrates, i.e., large reduction in $\beta$, a range for allowing the holding force to be set, which can be indicated by a fracture margin to the pressure ($\beta-\alpha$), will be much narrowed.

Furthermore, increase in temperature of the exhaust gas (temperature of the gas fed into the catalytic converter) will be caused to reach approximately 900 degrees centigrade, so that it is required to combine the shock absorbent mat 3 with alumina mat having a high temperature resistance. However, as the alumina mat does not have thermal expansion property, it is difficult to conform the alumina mat to a change in shape of the metallic container having thermal expansion property. In view of this, the minimum pressure $\alpha$ is required to be set larger than that set for the conventional process, and the bulk density of the shock absorbent mat 3 is required to be set relatively large. Therefore, in the case where the prior clamshell process or stuffing process is used, a wide variation of pressure (variation of the reduced amount from Sa1 to Sa2) has to be provided, as indicated by "A" in FIG. 5, which means that there is almost no margin for the minimum pressure $\alpha$ and isostatic strength $\beta$. According to the prior clamshell process or stuffing process, therefore, it is very difficult to insert the catalyst substrate or filter having thin walls into the housing under an appropriate pressure.

In order to solve the above problems, is used a so-called estimation sizing, wherein after the catalyst substrate 2 and shock absorbent mat 3 were loosely inserted into the cylindrical housing 4, the diameter of the cylindrical housing 4 is reduced by a certain amount, to compress the shock absorbent mat 3. According to this process, however, still relatively wide variation of pressure (variation of the reduced amount from Sb1 to Sb2) has to be provided, as indicated by "B" in FIG. 5, so that it is not so easy to use the estimation sizing for the prior clamshell process or stuffing process.

In contrast, according to the sizing process of the present embodiment, as indicated by "C" in FIG. 5, the variation of pressure can be reduced as small as 30% of the prior variation "A" (variation of the reduced amount from Sd1 to Sc2). As a result, a large margin of "D" can be ensured for the minimum pressure $\alpha$, so that the cylindrical housing provided with the catalyst substrate or filter having thin walls can be sized easily. In addition, with the margin of "D" enlarged, the range "C" of the variation of pressure can be shifted downward, so that the margin to the isostatic strength $\beta$ will be increased. Furthermore, because the pressure itself can be set at a low level, the working and control of the shock absorbent mat 3 will be easy, and the shock absorbent mat 3 can be made thin, with small clearances, to contribute the reduction in weight and cost of the product. According to the present embodiment, therefore, the catalyst substrate 2 can be held in the cylindrical housing 4 through the shock absorbent mat 3 without being fractured, in a stable condition, even if the catalyst substrate 2 is fragile.

Figure 6:
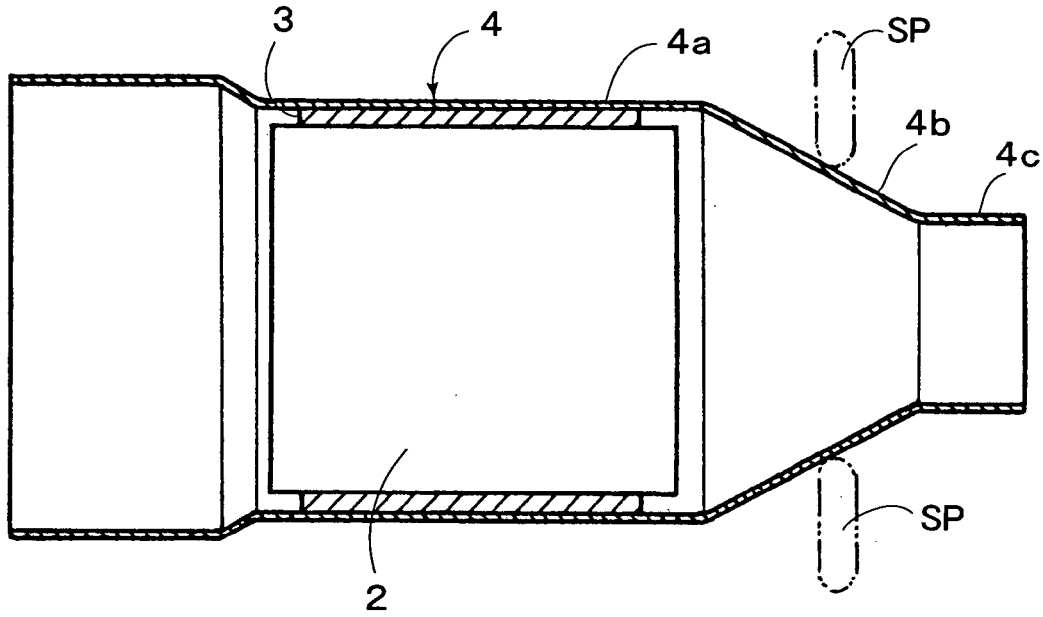
FIG. 6 is a sectional view showing a necking process by means of spinning rollers in a method according to an embodiment of the present invention.

Referring back to FIG. 8, after the body portion of the cylindrical housing 4 with the catalyst substrate 2 and the shock absorbent mat 3 accommodated therein was reduced in diameter, the necking process is applied to the opposite ends of the cylindrical housing 4 by a spinning process at Step 111, according to the present embodiment. At the outset, the body portion (reduced diameter portion 4*a* as shown in FIG. 6) of the cylindrical housing 4 is clamped by a clamp device (not shown) for a spinning apparatus (not shown), not to be rotated, and not to be moved axially. Then, the spinning process is applied to one end portion of the cylindrical housing 4, by means of a plurality of spinning rollers SP, which are revolved about the axis of the one end portion of the cylindrical housing 4 along a common circular locus. That is, the spinning rollers SP, which are positioned around the outer periphery of the end portion of the cylindrical housing 4, preferably with an equal distance spaced between the neighboring rollers, are pressed onto the outer surface of the end portion of the cylindrical housing 4, and revolved about the axis thereof, and moved along the axis (to the right in FIG. 6), with a revolutionary locus reduced, to achieve the spinning process. Accordingly, one end portion of the cylindrical housing 4 is reduced in diameter by the spinning rollers SP to provide a tapered portion 4*b* and a bottle neck portion 4*c* without any stepped portions formed between them, to form a smooth surface.

Figure 7:
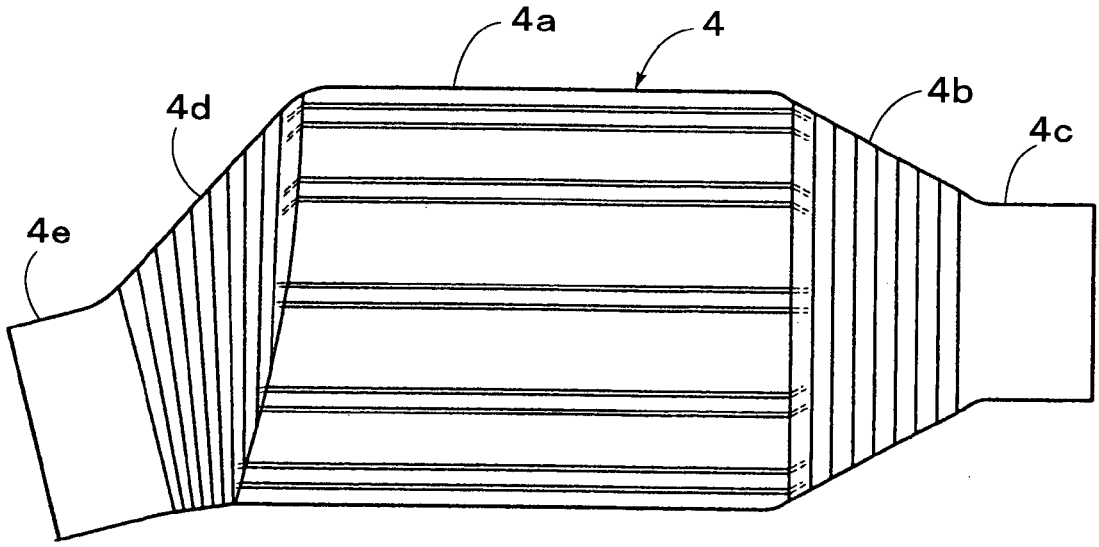
FIG. 7 is a side view showing an example of a finished catalytic converter produced according to a method of an embodiment of the present invention.

Next, the cylindrical housing 4 is reversed by 180 degree and positioned, so that the necking process is performed by means of the spinning rollers SP, with respect to the other one end portion of the cylindrical housing 4, as well, to form the tapered portion 4*b* and bottle neck portion 4*e* about the axis oblique to the axis of the body portion 4*a*. Consequently, a catalytic converter as shown in FIG. 7 is formed. In this case, a plurality of parallel traces are formed on the outer surface of the body portion 4*a* by the sizing process, and a plurality of streaks are formed on the outer surface of the tapered portion 4*b* and 4*d* by the spinning process. As indicated by broken lines in FIG. 7, the opposite ends of the traces formed in the shrinking process are disappeared when the tapered portion 4*b* and 4*d* are formed, and the remaining portions of the traces are connected at their opposite ends to the streaks to be perpendicular thereto. The traces as described above are resulted from such a specific process as using the sizing apparatus SM as shown in FIG. 1. The lines indicative of the traces and streaks as shown in FIG. 7 were emphasized for the sake of better understanding, while they are not so much noticeable, in fact. Preferably, they can not be noticed by eyes.

With respect to the shrinking processes performed at Steps 103 and 106 as shown in FIG. 8, the spinning rollers (SP) may be used for reducing the diameter of the body portion of the cylindrical housing as disclosed in Japanese Patent Laid-open Publication No. 2001-107725 (corresponding to the U.S. Pat. No. 6,381,843). Although the number of the catalyst substrate 2 is one according to the embodiments as described above, two substrates may be arranged along the longitudinal axis to provide a tandem type, or more than two substrates may be aligned. In the latter cases, the shrinking process may be applied to every portion of the housing covering each catalyst substrate, or may be applied to the entire housing continuously. And, the process as described above may be adapted to produce the finished products of not only the exhaust parts for automobiles, but also various fluid treatment devices including the reformer for use in the fuel cell as described before, or the like.

According to the present method as described above, the load applied to the catalyst substrate 2 for moving the same is monitored directly. As a result, the catalyst substrate 2 can be held with a desired holding force ensured at a high accuracy, with an error minimized. Therefore, the cylindrical housing 4 can be reduced in diameter, without being affected by an error in outer diameter of the catalyst substrate 2, error in inner diameter of the cylindrical housing 4, error of the shock absorbent mat 3, or the like. Furthermore, the cylindrical housing 4 is reduced in diameter at a high accuracy, without any controlling factors substituted for GBD as described before. In addition, as the load applied to the catalyst substrate 2 for moving the same, which is usually required for a finished product, is ensured as described before, a final examination for checking a possible (drawing) movement of the catalyst substrate 2, which is required in the prior methods, can be omitted according to the present method, which result in reduction of time for producing the product. According to the present method, therefore, the fluid treatment devices such as the catalytic converter and DPF can be produced easily in a relatively short time, and easily practiced on a mass-production line.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method of producing a container for holding a fragile substrate in a cylindrical housing with a shock absorbent member wrapped around the substrate, comprising:

inserting the substrate with the shock absorbent member wrapped around the substrate, into the cylindrical housing;

applying an axial load to the substrate so as to move the substrate along a longitudinal axis of the cylindrical housing by a predetermined distance, monitoring the axial load applied to the substrate; and reducing a diameter of at least a part of the cylindrical housing with the substrate held therein along the longitudinal axis of the cylindrical housing, with the shock absorbent member being compressed, to such an extent that the axial load equals a predetermined value.

2. The method of claim 1, wherein the diameter of the cylindrical housing is reduced at least twice, and the axial load is applied at least twice to the substrate so as to move the substrate along the longitudinal axis of the cylindrical housing by at least a first predetermined distance and second predetermined distance, respectively, monitoring the axial load applied to the substrate, and wherein a target reduced amount is provided for reducing the diameter of the cylindrical housing and holding the substrate in the cylindrical housing through the shock absorbent member with a desired holding force, on the basis of the applied axial loads and reduced amounts, and wherein the diameter of the cylindrical housing is reduced by the target reduced amount.

3. The method of claim 2, wherein the axial load is measured at least twice, when the axial load is applied at least twice to the substrate in the same direction, so as to move the substrate along the longitudinal axis of the cylindrical housing by at least the first predetermined distance and second predetermined distance, respectively.

4. The method of claim 2, wherein the axial load is measured twice, when the axial load is applied at least twice to the substrate in the opposite directions thereof, so as to move the substrate along the longitudinal axis of the cylindrical housing by either one of the first predetermined distance and second predetermined distance which are set to be equal.

5. The method of claim 1, wherein the diameter of the cylindrical housing is reduced according to a spinning process.

6. The method of claim 1, wherein the container is a catalytic converter for an automotive vehicle, and wherein the substrate is a catalyst substrate of a honeycomb structure for use in the catalytic converter.

7. A method of producing a container for holding a fragile substrate in a cylindrical housing with a shock absorbent member wrapped around the substrate, comprising:

inserting the substrate with the shock absorbent member wrapped around the substrate, into the cylindrical housing loosely;

reducing a diameter of at least a part of the cylindrical housing with the substrate held therein along the longitudinal axis of the cylindrical housing, with the shock absorbent member being compressed, to such an extent that the diameter is reduced by a first predetermined amount;

applying a first axial load to the substrate so as to move the substrate along a longitudinal axis of the cylindrical housing by a first predetermined distance, monitoring the first axial load applied to the substrate;

reducing the diameter of the cylindrical housing with the substrate held therein along the longitudinal axis of the cylindrical housing, with the shock absorbent member being compressed, to such an extent that the diameter is reduced by a second predetermined amount;

applying a second axial load to the substrate so as to move the substrate along a longitudinal axis of the cylindrical housing by a second predetermined distance, monitoring the second axial load applied to the substrate;

estimating a target reduced amount for reducing the diameter of the cylindrical housing to hold the substrate in the cylindrical housing through the shock absorbent member with a desired holding force, on the basis of a correlation property between the first and second axial loads and the first and second predetermined amounts, respectively; and reducing the diameter of the cylindrical housing with the substrate held therein along the longitudinal axis of the cylindrical housing, with the shock absorbent member being compressed, to such an extent that the diameter is reduced by the target reduced amount.

8. The method of claim 7, wherein the first and second axial loads are measured, when the first and second axial loads are applied to the substrate in the same direction, so as to move the substrate along the longitudinal axis of the cylindrical housing by the first predetermined distance and second predetermined distance, respectively.

9. The method of claim 7, wherein the first and second axial loads are measured, when the first and second axial loads are applied to the substrate in the opposite directions thereof, so as to move the substrate along the longitudinal axis of the cylindrical housing by either one of the first predetermined distance and second predetermined distance which are set to be equal.

10. The method of claim 7, wherein the diameter of the cylindrical housing is reduced according to a spinning process.

11. The method of claim 7, wherein the container is a catalytic converter for an automotive vehicle, and wherein the substrate is a catalyst substrate of a honeycomb structure for use in the catalytic converter.

* * * * *